US007497696B2

(12) United States Patent
Martinson et al.

(10) Patent No.: US 7,497,696 B2
(45) Date of Patent: Mar. 3, 2009

(54) SOCKET FOR LAND GRID ARRAY PACKAGE

(75) Inventors: Robert Martinson, Hillsboro, OR (US); Tieyu Zheng, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/729,581

(22) Filed: Mar. 29, 2007

(65) Prior Publication Data

US 2008/0242123 A1 Oct. 2, 2008

(51) Int. Cl.
*H01R 12/00* (2006.01)

(52) U.S. Cl. ..... 439/71

(58) Field of Classification Search ..... 439/66, 439/73, 71, 331

See application file for complete search history.

(56) References Cited

U.S. PATENT DOCUMENTS 6,648,655 B1 * 11/2003 Howell et al. ..... 439/71
6,669,490 B1 * 12/2003 DelPrete et al. ..... 439/86
6,731,516 B1 * 5/2004 Ma ..... 361/802
6,755,668 B2 * 6/2004 Copper et al. ..... 439/83
6,790,057 B2 * 9/2004 DelPrete et al. ..... 439/91
6,921,271 B2 * 7/2005 Liao et al. ..... 439/66
6,951,980 B2 10/2005 Matsunami
7,001,197 B2 2/2006 Shirai
2004/0072456 A1 * 4/2004 Dozier et al. ..... 439/83

* cited by examiner

*Primary Examiner*—Tho D Ta
(74) *Attorney, Agent, or Firm*—Blakely, Sokoloff, Taylor & Zafman LLP

(57) ABSTRACT

A land grid array socket and a microelectronic assembly including the socket. The socket comprises: a housing; an array of through-contacts on the housing; a solder ball standoff element on a PCB side of the housing; and a seating plane standoff element on a package side of the housing, the seating plane standoff element being aligned with the solder ball standoff element to form a loading force support element therewith.

13 Claims, 3 Drawing Sheets

SOCKET FOR LAND GRID ARRAY PACKAGE

FIELD

Embodiments of the present invention relate generally to land grid array (LGA) sockets having a housing with contacts that are electrically connected under pressure with corresponding contacts in a LGA package accommodated in the housing to form an electrical connection between the LGA package and a printed circuit board (PCB).

BACKGROUND

Various types of conventional integrated circuit (IC) sockets for attaching IC packages are known. Each of the IC packages has a large number of contacts that are arranged in a matrix-like array. The IC packages may be classified as pin grid array (PGA) packages, ball grid array (BGA) packages, or land grid array (LGA) packages depending on the shape of an electric contact portion of the contacts. The contacts in each of the IC packages are brought into contact with corresponding contacts arranged in a housing of the socket to establish electrical connections therebetween. The mating of the contacts in the IC package with the corresponding contacts in the socket typically causes a large contact pressure to be exerted on the socket by the loading mechanism loading force. Various socket configurations are known to provide the socket with sufficient strength to prevent deformation of the same.

FIG. 1 shows a cross-sectional of a portion of a prior art LGA socket 100 mounted onto a PCB 101 by way of an array 103 of solder balls. Hereinafter, a "portion" of the socket will be referred to as "socket," it being understood that only a portion of the socket being described has been shown. A LGA package 102 is shown as having a package substrate 116 and being mounted onto the PCB 101 by way of the socket 100 by being fixed and seated within the socket. The socket 100 includes a housing 104 having a solder ball standoff element 106 and a package seating plane standoff element 108 at a side thereof. The socket 100 further includes conductive through-portions 113 extending therethrough to outer contacts 112 on the PCB side thereof. The socket 100 further includes on its package side inner flexible contacts 114 contacting corresponding LGA lands. The combination of through-portions 113, outer contacts 112 and inner contacts 114 make up the socket through-contacts 115 as shown. A vertical load VL is shown acting onto a loading point of the package substrate. Reaction forces RF act on each of the solder ball standoff element 106 and seating plane standoff element 108 to counterbalance the VL. High risk areas of the socket 100 and package 102 for material yielding are indicated in FIG. 1 by way of star-shaped indicators.

To prevent deformation of a housing of a LGA socket when a large force is exerted in a vertical direction, such as VL shown in FIG. 1, a pair of metal reinforcements may be provided according to one prior art solution. The metal reinforcements clamp the LGA package and the socket fitted with the LGA package together from opposite sides (from both front and back surface sides) of a printed circuit board to which the socket is fitted. The metal reinforcements may include a loading plate or heat sink disposed on the LGA package and a board restraint plate disposed under a mount board. A screw may be passed through the loading plate or heat sink and the board restraint plate at each corner thereof and may be tightened by a nut to prevent deformation of the socket. The printed circuit board has apertures on a periphery thereof for accommodating the screws. This configuration, however, requires a larger footprint on the printed circuit board than that actually occupied by the socket itself. Thus, the socket size is large, a large number of parts, such as, screws, are required, and assembly is complicated.

According to another prior art solution, the LGA package and the socket may be disposed between a heat sink and a printed circuit board, and the socket is directly screwed to the printed circuit board. In this configuration, however, the printed circuit board is susceptible to warping.

Additionally, according to yet another prior art solution, a lever may be used to connect and maintain electrical connections between contacts of an IC package and corresponding contacts of a socket. The lever may be adapted to be engaged with a protrusion or elastic interlocking element integrally formed with a resin housing of the socket. The lever may be locked by the protrusion or elastic interlocking element to hold the electrical connections between the contacts. Since the protrusion or the elastic interlocking element is made of resin, the protrusion or the elastic interlocking element is apt to wear out due to friction with the lever during operation of the lever. The socket, therefore, is not durable. Forming the protrusion or the interlocking element as a separate metal member, on the other hand, increases the number of parts and the manufacturing costs.

Further, if the housing of the socket deforms when the LGA package is pressed by a cover member to form electrical connections between the contacts, the electrical contact array may become warped and deteriorate the electrical connections between the contacts. A force applied to the lever for actuation will also not efficiently be transferred.

Related prior art solutions for strengthening a LGA socket may include (1) increasing the stiffness of the package by increasing the IHS step thickness, (2) increasing package stiffness, (3) increasing the socket housing thickness, or (4) adding a metal frame onto the socket. However, the first three solutions go against market needs to minimize package and/or socket size, and the fourth solution adds significant cost to the package.

Figure 1:
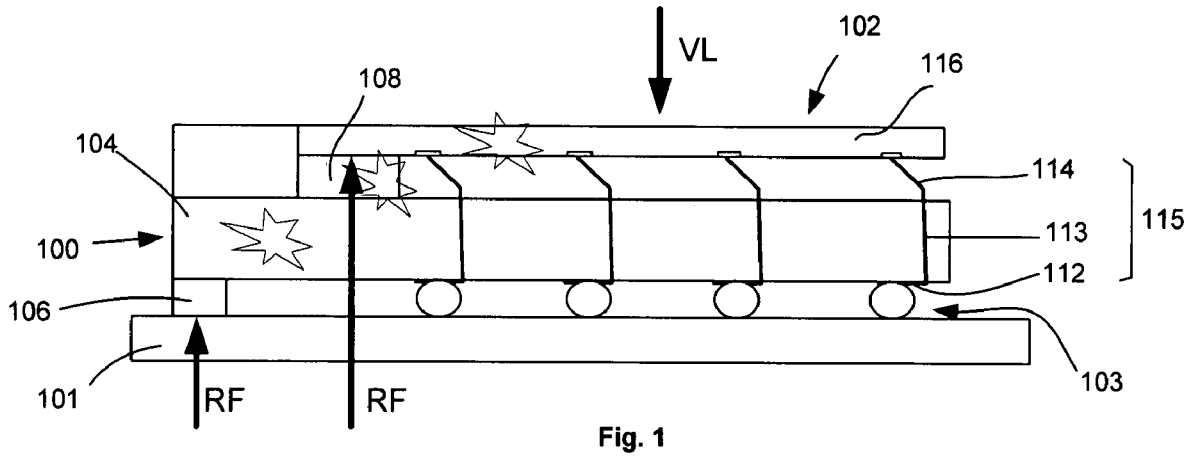
Fig. 1 Prior Art
FIG. 1 is a cross-sectional view of a LGA socket including a LGA package received therein according to the prior art.

For simplicity and clarity of illustration, elements in the drawings have not necessarily been drawn to scale. For example, the dimensions of some of the elements may be exaggerated relative to other elements for clarity. Where considered appropriate, reference numerals have been repeated among the drawings to indicate corresponding or analogous elements.

DETAILED DESCRIPTION

In the following detailed description, a LGA socket is disclosed. Reference is made to the accompanying drawings within which are shown, by way of illustration, specific embodiments by which the present invention may be practiced. It is to be understood that other embodiments may exist and that other structural changes may be made without departing from the scope and spirit of the present invention.

The terms on, above, below, and adjacent as used herein refer to the position of one element relative to other elements. As such, a first element disposed on, above, or below a second element may be directly in contact with the second element or it may include one or more intervening elements. In addition, a first element disposed next to or adjacent a second element may be directly in contact with the second element or it may include one or more intervening elements. In addition, in the instant description, figures and/or elements may be referred to in the alternative. In such a case, for example where the description refers to Figs. X/Y showing an element A/B, what is meant is that Fig. X shows element A and Fig. Y shows element B.

Aspects of this and other embodiments will be discussed herein with respect to FIGS. 2-5, below. The figures, however, should not be taken to be limiting, as they are intended for the purpose of explanation and understanding.

Figure 3:
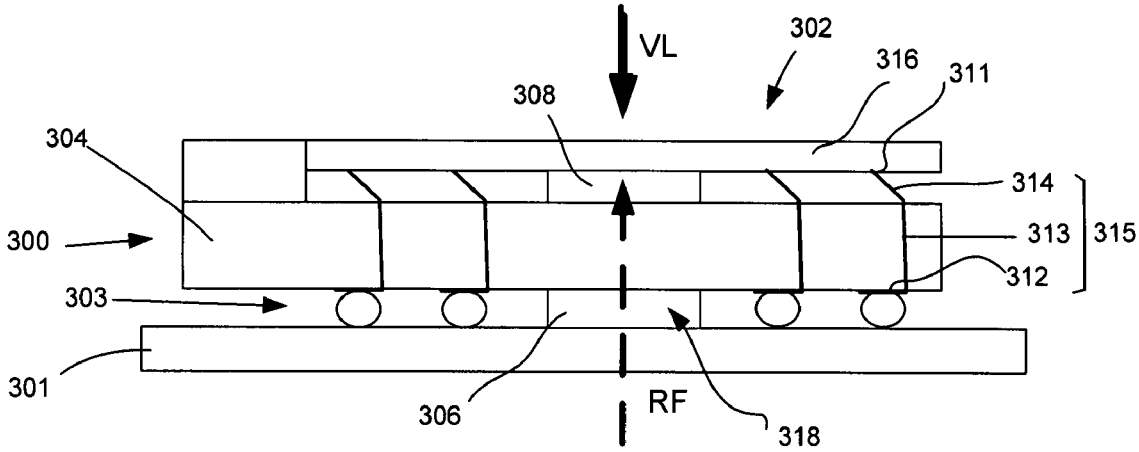
FIG. 3 is a cross-sectional view of a portion of a microelectronic assembly including the LGA socket of FIG. 2 and further including a LGA package seated therein according to a first embodiment.
Figure 4:
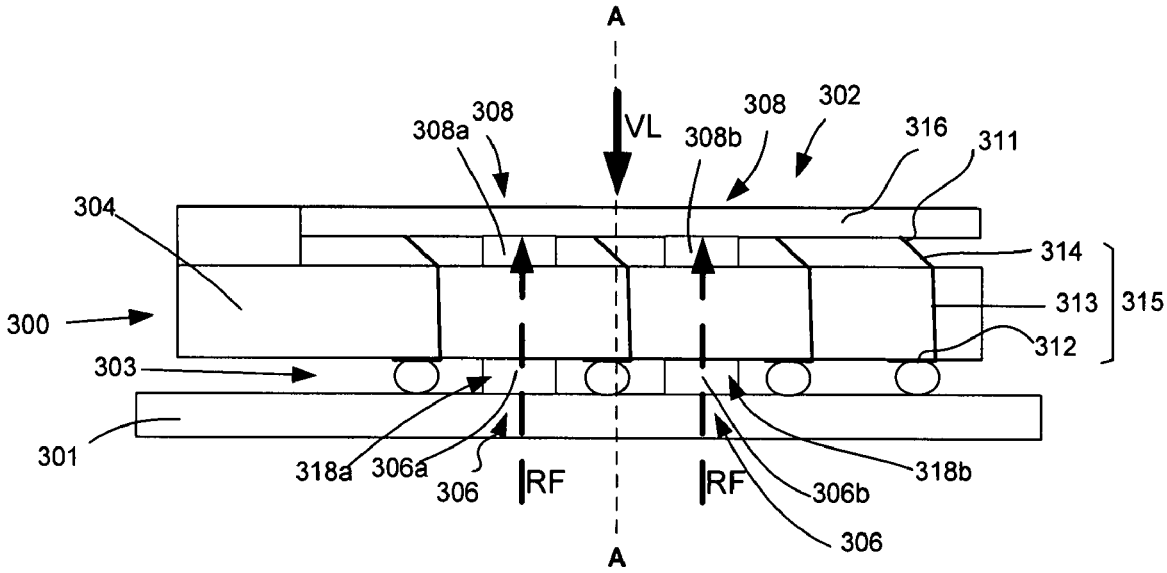
FIG. 4 is a cross sectional view of a portion of a microelectronic assembly including an LGA socket and a LGA package seated therein according to a second embodiment.

Reference is first made to FIGS. 3 and 4, in which a cross-sectional view of a portion of a microelectronic assembly 90 is shown. The figures show the assembly 90 as including a socket 300, a LGA package 302 having a package substrate 316 and being mounted/received within the socket, and a PCB 301 supporting the socket 300 and LGA package 302. FIGS. 3 and 4 show a portion of a LGA socket 300 mounted onto a PCB 301 by way of an array 303 of solder balls. A LGA package 302 is shown as being mounted onto the PCB 301 by way of the socket 300 by being fixed and seated within the socket. The socket 300 includes a housing 304, and an array of conductive through-portions 313 extending therethrough to an array of corresponding outer contacts 312 on the PCB side thereof. The socket 300 further includes on its package side an array of inner contacts 314 contacting corresponding LGA lands 311. According to the shown embodiment, the inner contacts 314 may comprise flexible contacts, although embodiments are not so limited. A combination of each of the outer contacts 312 with a corresponding conductive through-portion 313 and a corresponding inner contact 314 will hereinafter be referred to as a "through-contact" of the socket, one of the through-contacts of the array of through-contacts on the housing 304 being indicated by reference numeral 315.

According to embodiments, as shown in both FIGS. 3 and 4 by way of example, the socket 300 includes a solder ball standoff element 306 on a PCB side of housing 304, and a package seating plane standoff element 308 on a package side of housing 304, the seating plane standoff element 308 being aligned with the solder ball standoff element to form a loading mechanism loading force support element 318 therewith. In the instant description, a loading mechanism refers to any of a number of conventional loading mechanisms used to exert a loading force onto the socket and LGA package combination in a direction vertical to the LGA substrate to mate the lands 311 with the through-contacts 315. An example of such a force is shown schematically by way of arrow VL in FIGS. 3 and 4. Additionally, as used in the instant description, a solder ball standoff element is "aligned" with a seating plane standoff element and disposed to form a "loading force support element" according to the instant description where the solder ball standoff element and the seating plane standoff element are disposed with respect to one another on each side of the housing (i.e. PCB side and package side) such that, upon application of the loading mechanism loading force, such as VL of FIG. 3 or 4, a reaction force to the loading force is created that has a load path through both the solder ball standoff element, and the seating plane standoff element, such as RF of FIG. 3 or 4. Stated another way: (1) the solder ball standoff element and seating plane standoff element are aligned according to embodiments where a line vertical to either one of the PCB side or the package side of the housing may be disposed to intersect both solder ball standoff element and seating plane standoff element; and (2) solder ball standoff element and seating plane standoff element are positioned to form a loading force support element where a reaction force to the loading mechanism loading force is created that has a reaction force component having a path through both solder ball standoff element and seating plane standoff element. According to the embodiment of both FIGS. 3 and 4, the solder ball standoff element and seating plane standoff element are aligned with one another in a substantially centered manner. However, embodiments are not so limited, and include within their scope the positioning of the solder ball standoff element and seating plane standoff element in an aligned manner as long as a reaction force load path may exist through both solder ball standoff element and seating plane standoff element. Thus, solder ball standoff element and seating plane standoff element may be aligned in an offset manner with respect to one another according to one embodiment. Additionally, according to the embodiments of both FIGS. 3 and 4, the solder ball standoff element and seating plane standoff element may be co-extensive with one another. In other words, a footprint of the solder ball standoff element on the package side of the socket 300 may configured and disposed to be symmetrical with a footprint of the seating plane standoff element on the PCB side of the socket 300. According to one embodiment the solder ball standoff element 306 and the seating plane standoff element 308 may be formed integrally with housing 304. Optionally, the housing 304 may comprise a plastic material. Preferably, the solder ball standoff element 306 and the seating plane standoff element 308 are made of the same material as that of the housing 304. Embodiments also comprise within their scope the provision of a solder ball standoff element and seating plane standoff element that are fixed to the housing in a conventional manner. In addition, although the shown embodiment of FIG. 3 depicts standoff elements 306 and 308 in predetermined locations of the socket, embodiments comprise within their scope additional standoff elements, either for the solder ball area or for the seating plane area, placed at additional locations of the socket according to application needs.

According to a first embodiment as shown by way of example in FIG. 3, the loading force support element 318 may be disposed at a location of the loading mechanism loading force VL. Here, the reaction force RF and the loading force VL may be approximated by vectors defined along a common line through the solder ball standoff element and the seating plane standoff element.

According to a second embodiment as shown by way of example in FIG. 4, the solder ball standoff element 306 in fact includes a plurality of solder ball standoff elements **306*a* and 306*b*, and the seating plane standoff element 308 includes a plurality of seating plane standoff elements 308*a* and 308*b*. Here, the seating plane standoff elements 308*a* and 308*b* are aligned with corresponding ones of the solder ball standoff elements 306*a* and 306*b* to form respective loading force support elements 318*a* and 318*b* as shown. In the shown embodiment, the loading force support elements 318*a* and 318*b* are disposed in respective interstices 320*a* and 320*b* between pairs of the through contacts 315. Additionally, the shown embodiment of FIG. 4 shows the loading force support elements as being distributed substantially symmetrically with respect to an axis A-A defined by a vector of a loading mechanism loading force VL. Embodiments are not so limited, however, and comprise within their scope the provision of a plurality of loading force support elements in any manner with respect to axis A-A according to application needs. It is further to be noted that the socket may be configured such that, before application of a loading force VL, a small gap exists between the solder ball standoff element 306 and the PCB 301**, which gap would then close upon VL being applied to the socket.

Figure 2:
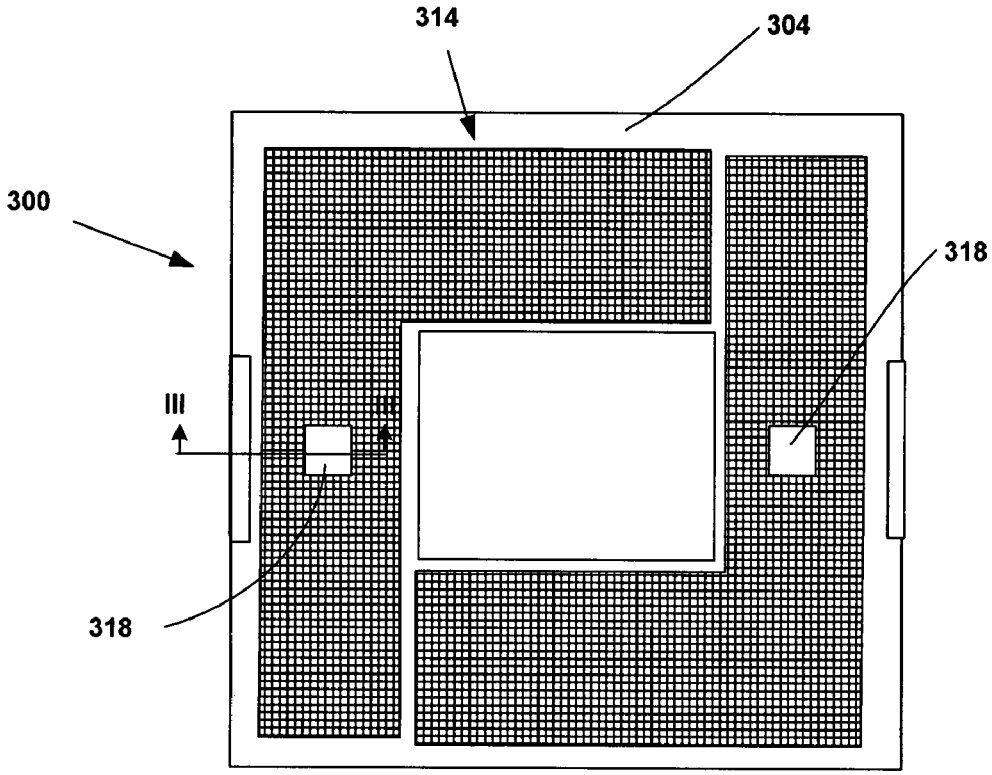
FIG. 2 is a top plan view of a LGA socket according to an embodiment.

FIG. 2 is a top plan view of a socket, such as socket 300, according to one embodiment. Here the socket housing 304 includes the array of inner contacts 314, and loading force support elements 318 as shown. A cross section through lines III-III in FIG. 2 would yield the view shown in FIG. 3.

Advantageously, embodiments provide a socket housing design that is unique in that the seating plane standoff is aligned with the solder ball standoff to create an efficient, vertical load distributing system for the loading force. Embodiments are especially suited for CPU sockets with ever increasing pin counts having greater enabling load requirements for LGA contact compression. Preferably, the standoffs are aligned at a location directly under the loading mechanism load point of the CPU enabling stack, in this way ensuring optimum failure protection for the socket and LGA substrate. Thus, embodiments substantially eliminate package and socket risk areas for material yielding, and minimize socket deflection under the enabling load to improve the interface between LGA package and socket. Additionally, advantageously, embodiments prevent excessive solder ball creep near the standoff location(s), and provide a simple and cost-effective solution that increases the margin for bake testing.

Figure 5:
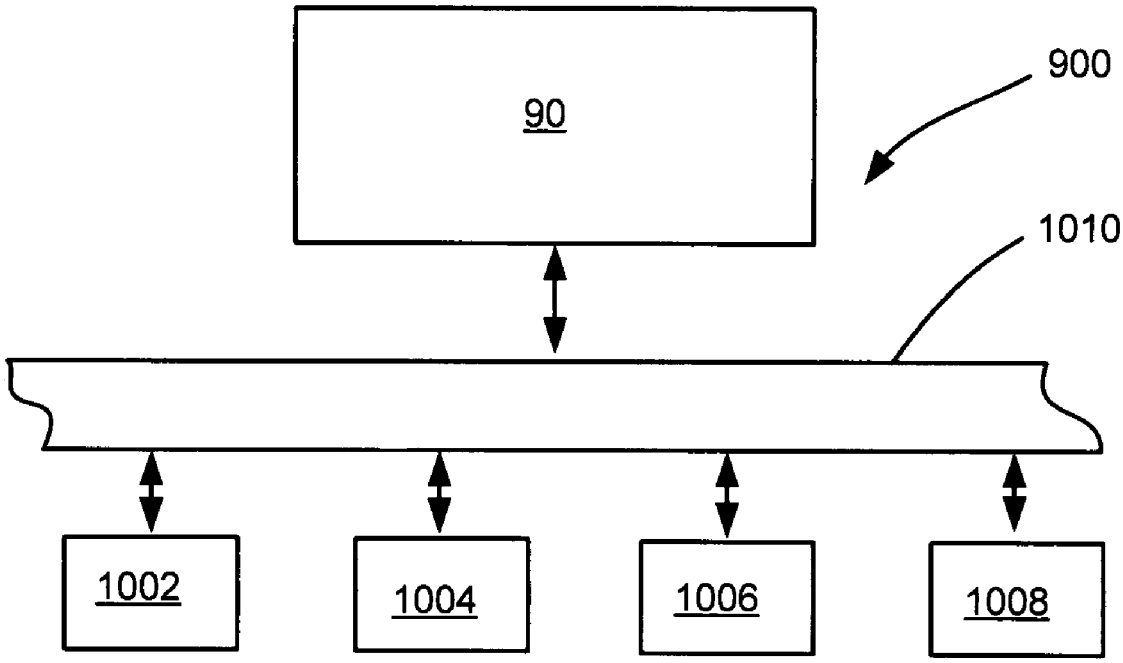
FIG. 5 is a schematic view of a system including a microelectronic assembly according to an embodiment.

Referring to FIG. 5, there is illustrated one of many possible systems 900 in which embodiments of the present invention may be used. In one embodiment, system 900 may include a microelectronic assembly such as assembly 90 of FIG. 3 or 4. System 900 may further include a microprocessor. In an alternate embodiment, the system 900 may include an application specific IC (ASIC). Integrated circuits found in chipsets (e.g., graphics, sound, and control chipsets) may also be packaged in accordance with embodiments of this invention.

For the embodiment depicted by FIG. 5, the system 900 may also include a main memory 1002, a graphics processor 1004, a mass storage device 1006, and/or an input/output module 1008 coupled to each other by way of a bus 1010, as shown. Examples of the memory 1002 include but are not limited to static random access memory (SRAM) and dynamic random access memory (DRAM). Examples of the mass storage device 1006 include but are not limited to a hard disk drive, a compact disk drive (CD), a digital versatile disk drive (DVD), and so forth. Examples of the input/output module 1008 include but are not limited to a keyboard, cursor control arrangements, a display, a network interface, and so forth. Examples of the bus 1010 include but are not limited to a peripheral control interface (PCI) bus, and Industry Standard Architecture (ISA) bus, and so forth. In various embodiments, the system 90 may be a wireless mobile phone, a personal digital assistant, a pocket PC, a tablet PC, a notebook PC, a desktop computer, a set-top box, a media-center PC, a DVD player, and a server.

The various embodiments described above have been presented by way of example and not by way of limitation. Having thus described in detail embodiments of the present invention, it is understood that the invention defined by the appended claims is not to be limited by particular details set forth in the above description, as many variations thereof are possible without departing from the spirit or scope thereof.

What is claimed is:

1. A land grid array socket comprising:

a housing;

an array of through-contacts on the housing;

a solder ball standoff element fixedly connected to a POB side of the housing; and a seating plane standoff element fixedly connected to a package side of the housing, the seating plane standoff element being aligned with the solder ball standoff element and positioned to form a loading force support element therewith, wherein the solder ball standoff element and the seating plane standoff element are aligned with a loading mechanism loading force.

2. The socket of claim 1, wherein the solder ball standoff element and the seating plane standoff element are aligned with one another in a substantially centered manner.

3. The socket of claim 1, wherein the solder ball standoff element and the seating plane standoff element are co-extensive with one another on each side of the housing.

4. The socket of claim 1, wherein the solder ball standoff element and the seating plane standoff element are integral with the housing.

5. The socket of claim 1, wherein:

the solder ball standoff element includes a plurality of solder ball standoff elements;

the seating plane standoff element includes a plurality of seating plane standoff elements, the seating plane standoff elements being aligned with corresponding ones of the plurality of solder ball standoff elements to form respective loading force support elements therewith.

6. The socket of claim 5, wherein each of the loading force support elements is disposed in an interstice between a pair of the through-contacts.

7. The socket of claim 5, wherein the loading force support elements are distributed substantially symmetrically with respect to an axis defined by a vector of a loading mechanism loading force.

8. A microelectronic assembly comprising:

a land grid array package including an array of lands on a POB side thereof;

a land grid array socket, the package being received within the socket, the socket comprising:

a housing supporting the package therein;

an array of through-contacts on the housing, the array of through contacts including:

an array of inner contacts in electrical contact with the array of lands of the package; and an array of outer contacts; and through-portions extending through the housing from the array of inner contacts to the array of outer contacts;

a solder ball standoff element fixedly connected to a POB side of the housing; and a seating plane standoff element fixedly connected to a package side of the housing, the seating plane standoff element being aligned with the solder ball standoff element and positioned to form a loading mechanism loading force support element therewith; and a PCB including an array of solder balls in electrical connection with the array of outer contacts of the socket, wherein the solder ball standoff element extends between the PCB and the housing prior to the application of a loading mechanism loading force, and the seating plane standoff element extends between the package and the housing, wherein the solder ball standoff element and the seating plane standoff element are vertically aligned with the loading mechanism loading force.

9. The assembly of claim 8, wherein the solder ball standoff element and the seating plane standoff element are aligned with one another in a substantially centered manner.

10. The assembly of claim 8, wherein the solder ball standoff element and the seating plane standoff element are coextensive with one another on each side of the housing.

11. The assembly of claim 8, wherein the solder ball standoff element and the seating plane standoff element are integral with the housing.

12. The assembly of claim 8, wherein:

the solder ball standoff element includes a plurality of solder ball standoff elements;

the seating plane standoff element includes a plurality of seating plane standoff elements, the seating plane standoff elements being aligned with corresponding ones of the plurality of solder ball standoff elements to form respective loading force support elements therewith.

13. The assembly of claim 12, wherein each of the loading force support elements is disposed in an interstice between a pair of the through-contacts.

* * * * *

UNITED STATES PATENT AND TRADEMARK OFFICE

CERTIFICATE OF CORRECTION

PATENT NO. : 7,497,696 B2
APPLICATION NO. : 11/729581
DATED : March 3, 2009
INVENTOR(S) : Martinson et al.

It is certified that error appears in the above-identified patent and that said Letters Patent is hereby corrected as shown below:

In column 6, at line 7 delete "POB" and insert --PCB--.

In column 6, at line 14 after "are" insert --vertically--.

In column 6, at line 41 delete "POB" and insert --PCB--.

In column 6, at line 54 delete "POB" and insert --PCB--.

Signed and Sealed this

Twenty-eighth Day of September, 2010

David J. Kappos

David J. Kappos
*Director of the United States Patent and Trademark Office*